US006164201A

United States Patent [19]

Burke

[11] Patent Number: 6,164,201

[45] **Date of Patent: *Dec. 26, 2000**

[54] METHOD AND APPARATUS FOR WEB STEERING

[75] Inventor: David Charles Burke, Portsmouth, N.H.

[73] Assignee: Heidelberger Druckmachinen AG, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/151,278

[22] Filed: Sep. 11, 1998

[51] Int. Cl.[7] ..... B41F 13/54

[52] U.S. Cl. ..... 101/228; 101/219; 226/21

[58] Field of Search ..... 101/228, 219, 101/181; 226/20, 21, 180; 242/615.1

[56] References Cited

U.S. PATENT DOCUMENTS

| | | | |
|---|---|---|---|
| 4,477,006 | 10/1984 | Sharp | 226/21 X |
| 4,598,849 | 7/1986 | Frye et al. | 226/21 |
| 4,848,632 | 7/1989 | Mack et al. | 226/20 X |
| 4,961,089 | 10/1990 | Jamzadeh | 226/21 X |
| 5,490,459 | 2/1996 | Hoff | 101/243 |
| 5,540,146 | 7/1996 | Lapp | 101/228 X |
| 5,558,263 | 9/1996 | Long | 226/21 X |
| 5,667,123 | 9/1997 | Fukuda | 226/21 |
| 5,711,470 | 1/1998 | Thompson | 226/21 X |

OTHER PUBLICATIONS 1 page illustration of Quad Tech System 2000, dated Jan. 1987.

Baldwin Web Guide Controls, Models 901/902/903, 2 pages, MC 2M Dec. 1990.

MicoTrak Series 4400, Linear Web Guide, Web Printing Controls Co., Inc. 2 pages.

CMI.CMB Digital Web Guides, Automatic Web Alignment For Maximum Productivity, Meg document, 1 page.

Extensive Range Allows Detection of Microparts, Keyence, $LX2_{-13}$, Laser through–Beam Photo–Sensor Wide–Beam Type, Cat. No. NLX2–13, 2 pages.

*Primary Examiner*—John S. Hilten
*Assistant Examiner*—Minh Chau
*Attorney, Agent, or Firm*—Burns Doane Swecker & Mathis LLP

[57] ABSTRACT

The present invention is directed to providing apparatus and methods for lateral position control using a web guide which detects a relative lateral shift of a web upstream of a control device. Error correction is thereby implemented using a phase advance rather than a phase lag. The lateral displacement control can be implemented continuously, or can be activated at certain times (e.g., when a new roll is spliced to an old roll, or when disturbances enter the system). The invention eliminates wasted time and wasted paper, by eliminating misalignment of a web with respect to a printing unit.

14 Claims, 4 Drawing Sheets

METHOD AND APPARATUS FOR WEB STEERING

BACKGROUND OF THE INVENTION

1. Field of the Invention

The present invention is directed to web guides, such as web guides used to steer webs in offset printing presses.

2. State of the Art

Web guides are often used to control lateral web position and/or to correct lateral misalignment of a moving web. Commonly assigned U.S. Pat. No. 5,490,459 discloses the use of a web guide in a web printing press to laterally displace a web. U.S. Pat. No. 5,490,459 is directed to intentionally shifting the lateral web position during use of the web to wash the blanket cylinder in printing units of the press. That is, the web is shifted back and forth laterally to clean the blanket cylinder. This patent is not directed to correcting unintentional, lateral misalignments of a web. Moreover, the known guide does not perform well enough because an intentionally induced lateral web shift is not fully corrected by the web guide. It appears that known guides can correct at a high enough rate, but the shifted web has to pass through the guide area to be noticed. The error therefore remains until the shifted direction is noticed and changed.

Web guides are also known for correcting web misalignments. For example, when a new paper roll of the printing press is spliced to a previous roll, the new paper roll may not be laterally aligned with the previous paper roll. Web misalignments can also result from other sources, such as cross-web tension variations, changes in the width of new rolls spliced to the web, natural frequencies and so forth. These deviations can be both low frequency deviations and high frequency deviations. Traditionally, there are two web guides in a press system; one guide to correct web position going into the print units and one guide correcting the web position as it goes into the slitters/folder. Accordingly, a device is used to correct misalignment of the eb for proper registration with respect to print units of the press.

Conventional web guides are configured as a "box" having four idler rolls arranged such that in a cross sectional view, the four rolls are in a square or rectangular pattern. The entry and exit rolls are typically fixed in position, and two inside rolls are configured on a pivoting carriage which moves according to a desired output position of the web.

FIGS. 1A and 1B illustrate a known web guide 100 which includes downstream edge detecting sensors 102 to determine where a web 106 is positioned, laterally. FIGS. 1A and 1B illustrate a web guide control system such as that described in a brochure of MEG Inc. of East Rutherford, N.J. The correction is achieved by pivotally moving the pivoting carriage 104, which includes dual idler rolls 108, about an axis 110. The edge detecting sensors 102 are located at the exit of the web guide. A computer control including a proportional/integral/derivative (PID) regulator drives the pivoting carriage 104 about rotational axis 110. By rotating the carriage 104 about this axis in a counterclockwise direction, the web can be shifted in one lateral direction. Rotation in the clockwise direction can induce a lateral shift of the web in a second opposite lateral direction. In its direction of travel, the web passes over an idler roll 112, into pivot rolls 108 of the web guide. The web then passes from the pivot rolls 108 around another idler roll 114. The pivoting of the web to correct for lateral misalignments is performed on the pivot rolls 108. The sensors 102 detect an actual lateral misregistration of the web, and send a signal to the computer control, which then tries to correct the lateral displacement via the carriage 108.

Because the web can enter the web guide at lateral positions which will vary randomly and/or at any of several frequencies, and because there is only one desired exit position, the control system of the FIG. 1A, 1B web guide must respond to a wide range of lateral web errors. As the frequency of the positional web error increases, the web guide is less able to filter the web position to a stable condition. In addition, because the sensors 102 are located downstream of the pivoting carriage 104, web steering errors will pass through the span where they can be corrected. The correction therefore lags the actual measured error, and allows a lateral web error at the exit of the steering guide, thereby degrading product quality. Because printing press speeds have increased over the years, the problem of correcting web positional errors using a downstream sensor results in an increased amount of unacceptable product passing through the printing press.

Other similar systems known in the art are described in product brochures available from Baldwin Web Controls of Countryside, Ill., (e.g., Web Guide Control models 901/902/903), and from Web Printing Controls Company, Inc. of Lake Barrington, Ill. Although conventional web guides can correct low frequency shifting and low rate step changes (e.g., shifts on the order of about 0.002 inches/second and lower), they are unable to correct web weaving at higher frequencies and/or higher rate step changes (e.g., on the order of about 0.2 inches/second and higher).

Accordingly, it would be desirable to provide methods and systems for lateral position control of a web which overcomes the foregoing deficiencies.

SUMMARY OF THE INVENTION

The present invention is directed to providing apparatus and methods for lateral position control using a web guide which detects a relative lateral shift of a web upstream of a control device. Error correction is thereby implemented using a phase advance rather than a phase lag. The lateral displacement control can be implemented continuously, or can be activated at certain times (e.g., when a new roll is spliced to an old roll, or when disturbances enter the system). The invention eliminates wasted time and wasted paper, by eliminating misalignment of a web with respect to a printing unit.

Generally speaking, the present invention relates to methods and apparatus for guiding a web, such as a web of an offset printing press, by: transporting the web along a path from a web input to a web output; correcting a lateral shift of said web at a first location along said path which is between said web input and said web output, and in response to a relative lateral shift of the web; and detecting said relative lateral shift using a detector at a second location which is between said web input and said first location.

BRIEF DESCRIPTION OF THE DRAWINGS

Other objects and advantages of the present invention will become more readily apparent from the following detailed description of the preferred embodiments, when read in conjunction with the accompanying drawings, wherein like elements have been designated by like reference numerals, and wherein.

DETAILED DESCRIPTION OF THE PREFERRED EMBODIMENTS

Figure 1A:
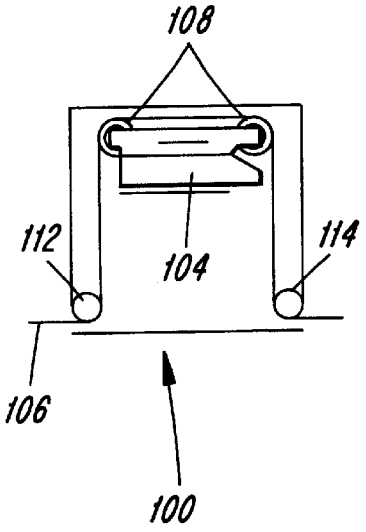
FIGS. 1A and 1B illustrate a conventional web steering system.
Figure 1B:
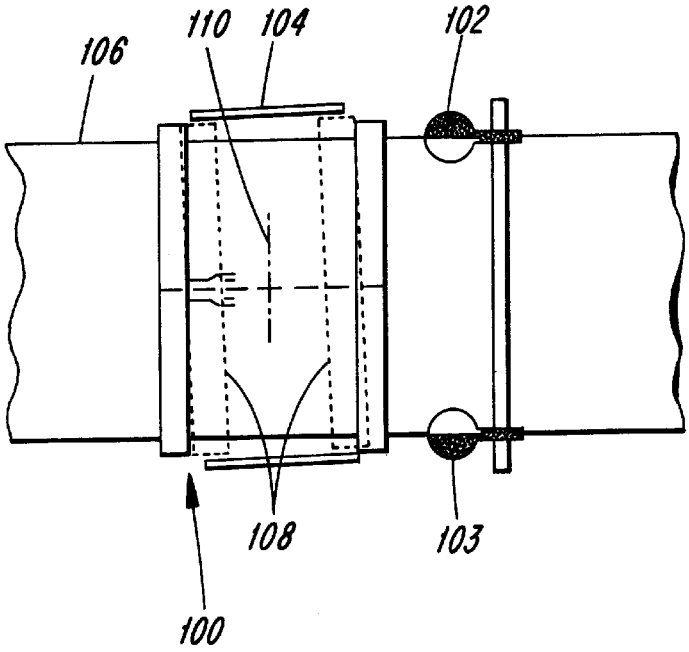
Figure 2:
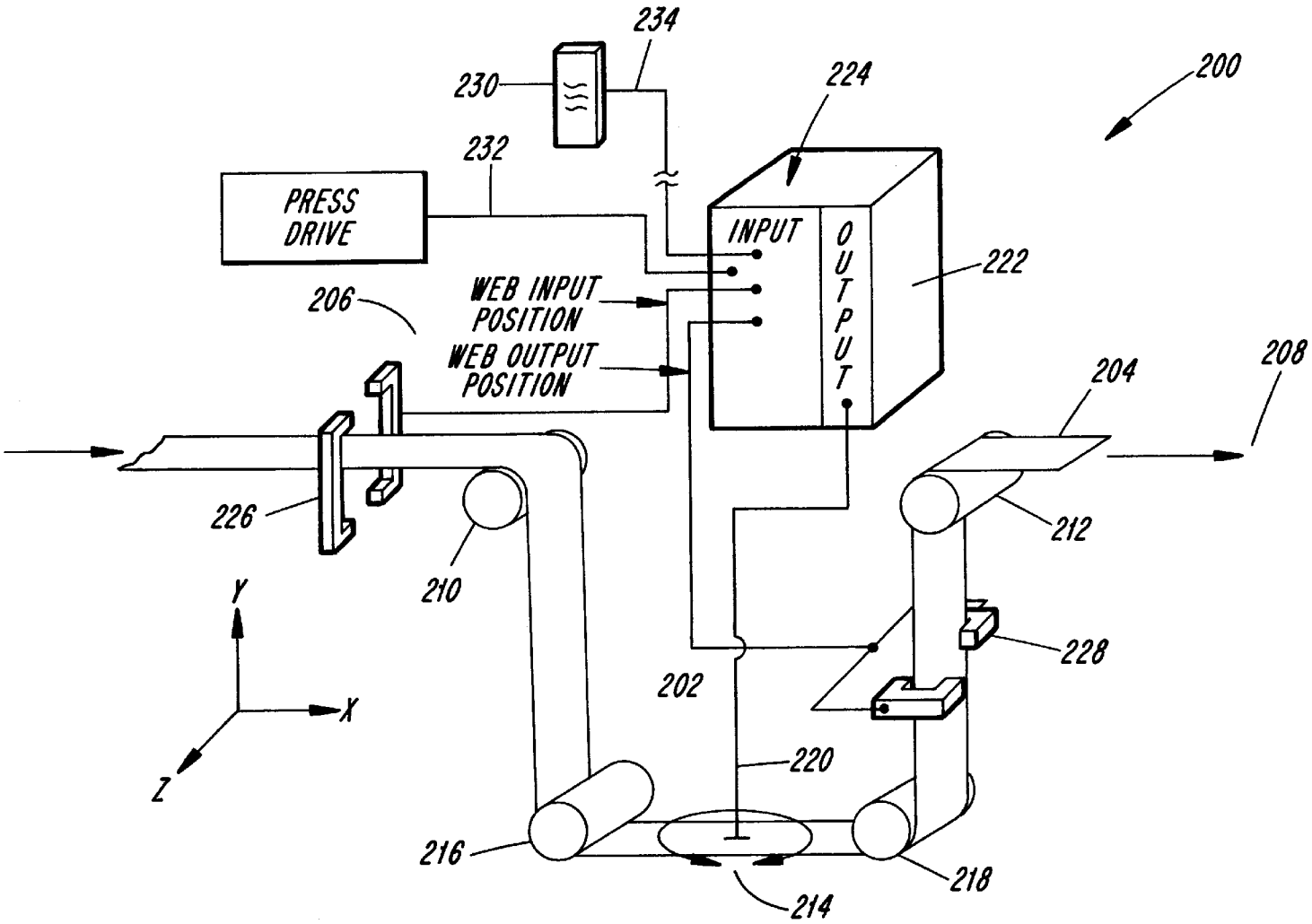
FIG. 2 illustrates an exemplary embodiment of a web steering system in accordance with the present invention.

FIG. 2 illustrates an exemplary embodiment of an apparatus 202 for guiding a web 204, implemented in conjunction with a printing press 200. In the FIG. 2 embodiment, the web 204 is transported from a web input 206 to a web output 208 along a transport path which includes idler rolls 210 and 212. The apparatus for guiding the web includes means for correcting a lateral shift of the web at a first location along the web path which is between the web input 206 and the web output 208. For example, in the FIG. 1 embodiment, a rotatably mounted web carriage 214 having web rolls 216 and 218 is provided.

The web carriage 214 is pivotable about an axis 220 which corresponds to a conventional linkage for rotating the web carriage and which, as those skilled in the art will appreciate, need not be described in greater detail. The web carriage is driven by a carriage drive 222 which includes, for example, a DC motor associated with a controller 224 (e.g., a computer controller).

In the FIG. 2 embodiment, input data is used to manipulate the pivoting, dual idler roll web carriage to correct lateral web position shifts as they pass through the carriage. To achieve this control, relative lateral shifts are detected in advance of the web carriage by inputting data from web edge position sensors located before the pivoting web carriage. More particularly, a first web edge sensor 226 is located on an input side of the web carriage 214 to provide a relative positional change output signal which the controller 224 can use to drive the web carriage and cancel the undesired shift. The first primary, or "A", web edge sensor 226 measures a relative position of the web with respect to setpoint selected by the user so that an accurate amount of deflection can be introduced to the web via the web carriage 214.

A second primary, or B, web sensor 228 is located on an output side of the web carriage and can be used by the controller to determine that an absolute web position has been maintained, the absolute web position having been selected by the user. The second web edge sensor 228 measures an absolute position of the web to ensure proper alignment of the web with downstream printing units. The setpoint used with respect to the first web edge sensor and the absolute web position selected with respect to the second web edge sensor can, for example, be selected by the operator using a remote keypad 230. The controller 224 of the FIG. 2 embodiment receives inputs from the first and second web edge sensors 226, 228 representing a web input position and a web output position, respectively.

In accordance with exemplary embodiments, various press conditions can be monitored to optimize performance via the controller. For example, web speed can be monitored to ensure that it does not become to high for the web guide apparatus to correct lateral shifts. Various press conditions, such as press speed and web tension can be suppled to the controller 224 via a press condition input signal line or lines designated 232. User selector variables, such as a desired web position, can be input to the controller 224 from the remote keypad 230 via a signal line or lines 234.

The positioning control is proportional to the speed of the press because the speed of the press dictates how much space can exist between the web carriage and the second web edge sensor (which detects whether the correction was properly implemented with respect to alignment of the web with downstream printing units). If misalignment can not be detected and corrected quickly enough, the misaligned web will enter the printing units.

The first web edge sensor located upstream of the web carriage and the second web edge sensor located downstream of the web carriage will measure lateral web positions of differing magnitudes and frequencies. Any conventional sensor configuration can be used for both the first and second web edge sensors 226, 228 (such as infrared sensor pairs, wherein one sensor of each pair is associated with a first lateral edge of the web and a second sensor of each pair is associated with a second, opposite lateral edge of the web). Alternately, different types of conventional sensors can be used to implement the different functions of the sensors 226, 228. Although conventional web sensors can be used, the relative lateral shift error signal generated by the controller 224 from the output of web edge sensor 226 and a user selected setpoint, permits lateral shift errors to be detected with a phase advance, and corrected by the web carriage as the shifted web passes through the web carriage.

Figure 3:
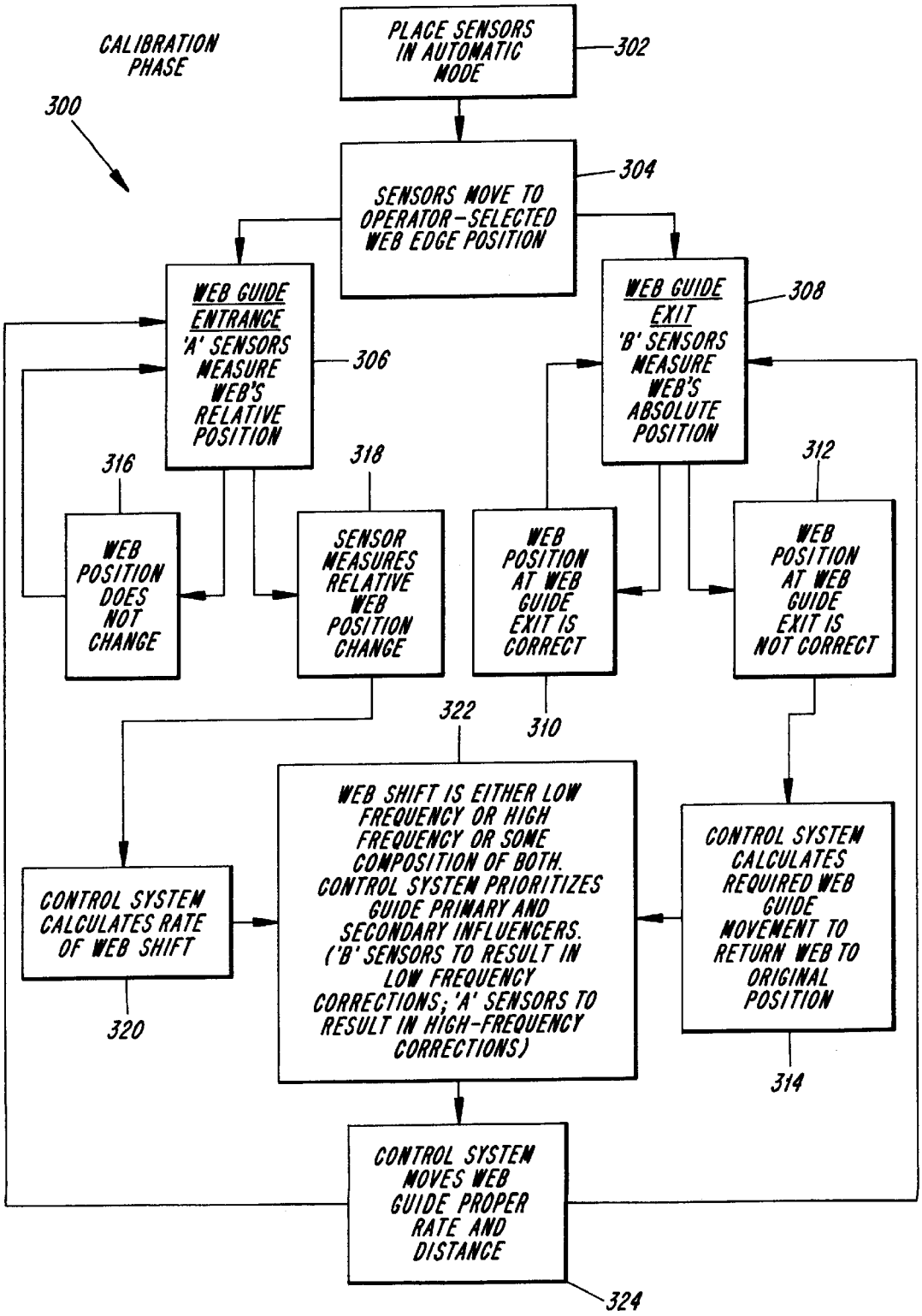
FIG. 3 illustrates a flow diagram of an exemplary control which can be implemented in accordance with the present invention.

FIG. 3 illustrates an exemplary flow chart 300 of an operation implemented by the controller 224 in accordance with the exemplary FIG. 2 embodiment. In a first step 302 of the FIG. 3 flowchart, the FIG. 2 controller 224 detects a start-up of the press, and initiates a calibration phase for the downstream and upstream sensors. In an exemplary embodiment, the pivoting carriage 214 can be pivoted to adjust the output position of the web without affecting the upstream sensors 226. As such, in an exemplary calibration operation, the upstream sensors 226 and the downstream sensors 228 can be calibrated at the same time, in parallel. Alternately, as those skilled in the art will appreciate, the sensors can be calibrated sequentially. For example, the upstream sensors 226 can be calibrated, followed by a calibration of the downstream sensors 228.

With entry of the calibration phase, the sensors 226 and/or 228 are placed into an automatic mode at the FIG. 3 step 304, wherein the sensors of each sensor pair are laterally displaced to preestablished "home" positions. The individual sensor of each sensor pair can be located on a laterally movable support, such as a rack and pinion support, or a belted system. During calibration, the two sensors, or sensor eyes, of each sensor pair can be moved laterally outward to their furthest, laterally displaced position (i.e., the "home" position), and then gradually moved inward until they cover a desired portion of the web's edge. For example, the sensor eyes can automatically transition to predetermined positions calculated for a given spacing between the sensors 226 versus the sensors 228, for a given web width, and for a given offset of the web centerline from a sensor centerline (i.e., an offset of the web centerline relative to a centerline between opposing sensor eyes of each sensor pair).

In the FIG. 3 flowchart, a parallel operation for calibrating the upstream and downstream sensors is illustrated. The controller can be configured to sense input data supplied by the remote keypad 230, such as a lateral shift setpoint of the web (i.e., the offset) in the "z" axis of FIG. 2, and an absolute position reference.

In the operation of step 304, the sensor eyes of a given sensor pair can be controlled to be initially directed wherever the operator intends. As those skilled in the art will appreciate, although a centerline of the web is typically aligned with a centerline between the sensor eyes, any desired offset can be established.

The calibration of the upstream sensors 226 will be described with respect to step 306 of FIG. 3. In step 306, the controller detects a relative lateral shift of the web by comparing the output of web edge sensor 226 and a lateral web position setpoint. Calibration of the upstream sensor 226 is performed using a seek and hold procedure whereby the sensor eyes of the sensor pair 226 are moved laterally inward from the predetermined "home" position until they are properly positioned relative to edges of the web. For example, the operator can establish a sensor setpoint at an eye location wherein each eye is located halfway over an edge of the web.

The sensors can be optical sensors, wherein an amount of light blocked by the web is used as a threshold for determining when a sensor eye is accurately positioned relative to the web. For example, if an unshielded sensor eye typically produces an output of 5 volts, then the sensor eye can be moved over the web until approximately one half of the eye is shielded from a light source by the web. At this point, the sensor output would be approximately 2.5 volts. A controller can therefore detect whether the eyes are properly located over the web. The use of two sensor eyes on opposite edges of the web allows for changes in the web to be determined at each web edge. Shifts of the web back and forth can be accurately determined during operation by comparing outputs of the two sensors. Use of two sensors permits variations in the web width to be distinguished from lateral shifts of the web.

In step 308, the downstream sensors 228 can be calibrated. Here, a desired, actual position of the web relative to the sensors at the web guide exit can be assessed. The sensor eyes can be adjusted until their centerline corresponds with a desired, absolute position of the web's centerline.

If desired, the calibration phase can include a correction of the actual web position to correspond with the desired web position. During this optional portion of the calibration phase, web transport is activated and the outputs from the sensors 226 and 228 are evaluated. If the web guide position is correct, as reflected in step 310, then the web position is properly set. However, if the web is not properly positioned, then as represented by step 312, a determination is made, and the control system is activated in step 314 to perform a correction operation by adjusting the pivoting carriage 114. During this calibration phase of operation, a check can be made with respect to the upstream sensors to ensure that the web position does not change (step 316). Because the web position does shift with respect to the upstream sensors, a correction procedure can be executed in parallel via steps 314 and 320.

That is, a measured web position change, or lateral shift, is detected in step 318. In step 320, the rate of the web shift is determined using the web shift detected for a given time interval. Meanwhile, in step 314, an absolute position error is determined.

In step 322, an amount of corrective action which must be imparted to the web guide is determined for the given error rate detected in step 320 and for the absolute position error detected in step 314. This information is combined into a composite guide control signal which is supplied to the web guide in step 324.

In addition, during this optional portion of the calibration phase, the pivoting carriage can be rolled back and forth to establish a predetermined offset of the web centerline from a centerline of the sensor eyes (i.e., a midpoint between the sensor eyes in a given sensor pair). The pivoting carriage rolls the pivot to steer the web to a centerline established by the eyes of the sensor.

After the calibration phase has been completed, ongoing operation can be implemented by continuously monitoring shifts of the web via the use of the upstream and downstream sensors in parallel. Composite, correctional control signals to compensate web shifts can be determined in step 322 and used to execute corrective measures in step 324. Return arrows from step 324 to the steps 306 and 308 illustrate that calibration and web shift corrections can be repeatedly performed during operation at predetermined intervals.

Those skilled in the art will appreciate that each of the upstream and downstream sensors can be operated continuously, and can scan concurrently in parallel. At each scan, the controller can read the output of each sensor and take corrective measures. Scanning by each of the sensors can be performed at any desired interval (for example, over 1, 5, 10, 20 or 40 millisecond intervals, or any other desired time interval). The controller receives information from the sensors, and controls the pivoting carriage in response thereto, based on composite calculations of the upstream and downstream sensors. In an exemplary embodiment, the upstream sensor has primary control when the sensors are used to correct displacements in parallel.

More particularly, after a correctional movement of the web has been implemented, the second web edge sensor 228 is used to detect an absolute web position to determine whether the absolute web position matches the desired lateral web position specified by the user for the printing press. If so, then the web lateral position has been corrected and properly aligned before it enters printing units located downstream of the web output 208. Monitoring therefore continues as represented by decision steps 312 and 314. Information from the second web edge sensor 228 can be used by the controller 224 to properly align the web with the downstream printing units, and/or to initiate a reexamination of data from the first web edge sensor 226 so that it can again be compared with the lateral shift setpoint specified by the user. In this latter case, the relative lateral web position sensed by the first web edge sensor 226 is again used by the controller to effect another phase advanced correction of the web carriage 214.

If a match does exist between the absolute lateral web position and the absolute lateral web position specified by the user, no further correctional movement is needed until another lateral web position error is detected. As represented by FIG. 3, monitoring can be implemented on a continuous basis to repeatedly monitor lateral web position of the web via either or both of the web edge sensors 226, 228.

In accordance with the exemplary embodiments, the two sensor embodiment of FIG. 2 addresses deficiencies of conventional web steering systems which have contributed to quality problems in a typical printing press print-to-fold specification. For example, as a web unwinds from a splicing machine and enters a printing unit, its path can vary laterally. If the web is permitted to follow a varying path through the various print units of the press, the print position with respect to the edge of the web will change accordingly. One typical end result of the printing process is to fold the web with respect to the web edge. Thus, if the print is moving with respect to the web edge, then the print/fold position will vary. The tolerance for a print/fold error is a tightly controlled specification in a printing press.

Exemplary embodiments of the present invention avoid unacceptably large lateral web movements by controlling lateral web displacement to correct errors as they occur. Using the first web edge sensor and the controller, lateral corrections of the web can be determined before the web passes through the web steering guide to implement corrective action with a phase advance. Use of a phase leading correction prevents web overcorrection which, in conventional web guides, occurred because the conventional downstream sensor directed the carriage to continue to move after the web shift stopped or reversed direction.

Web shifts of either low frequency or high frequency, or any combination thereof can be corrected in accordance with exemplary embodiments. A control system in accordance with exemplary embodiments prioritizes primary and secondary influences on the control system, with the downstream sensors providing information for low frequency shift corrections, and with the upstream sensors providing information for high frequency shift corrections.

Figure 4:
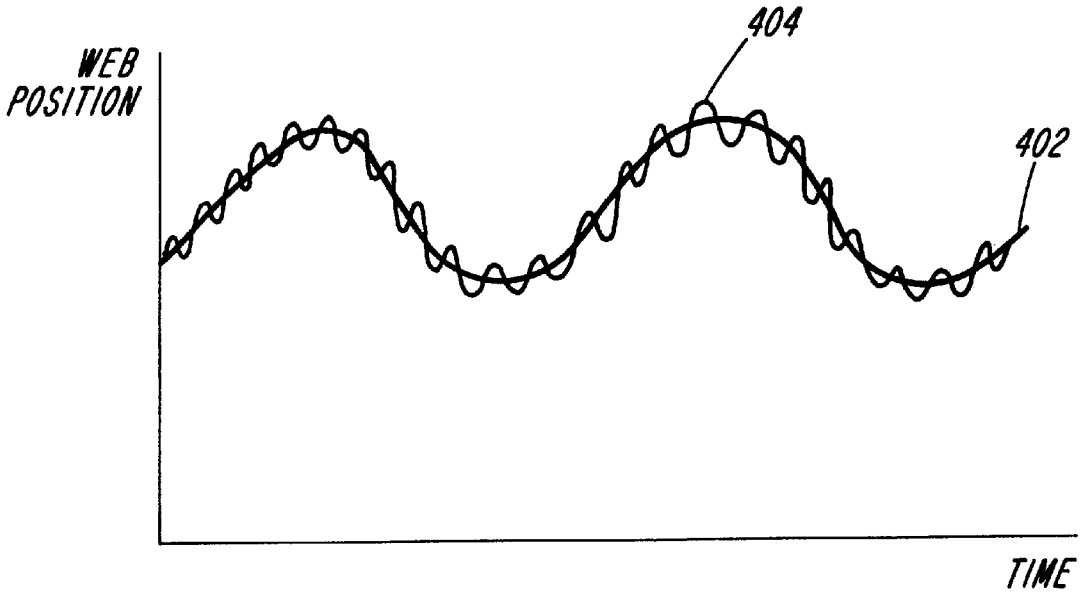
FIG. 4 shows an exemplary graph of web position versus time in accordance with the present invention.

Referring to FIG. 4, a graph is shown of an exemplary web displacement, wherein web position is shown on the vertical axis and time is shown on the horizontal axis. High frequency web shifts as represented by waveform 404 are corrected by the upstream sensor 226, while low frequency shifts as represented by waveform 402 are corrected by the downstream sensor 228. Because the web guide control signal produced in steps 322 and 324 will track web shifts, the composite of waveforms 402 and 404 can be considered an exemplary web guide control signal.

In the exemplary FIG. 2 embodiment, the sensors can be selectively disengaged to allow for cleaning (e.g., removal of paper dust). Further, the controller can provide a performance feedback indicator to alert the user when excessive error has been detected. The controller can also provide an output to the folding machine to prevent paper jams caused by specified web shifts.

Those skilled in the art will appreciate that other embodiments of the present invention can be implemented. For example, the location of the upstream sensor shown to be inside the four-roll web guide arrangement of FIG. 2. However, the location need not be necessarily be as shown, because the sensor needs only to be part of the upstream to give the control system enough time to perform calculations, send instructions, and move the mechanical systems associated with the pivoting carriage. If the upstream sensor 226 detects a shift when the shift is too close to the correcting rolls of the pivoting carriage, the shift may get through before the correcting can cancel out the shift. In general, the downstream sensors are located close to the fourth roll (between the third and fourth rolls) so the errors can be detected as soon as they pass through the correcting system. The sensor on the upstream side measures the shift as soon as possible so the sensor location can be some number of feet before the first web guide roll. With such a system, the control system can also be configured to learn an optimum correction rate and timing based on feedback from the downstream sensor 228.

Exemplary embodiments can, in addition, or in place of optical sensors, use infrared sensors, or can use a semiconductor laser or photo diode, operating in any desired frequency range (e.g., visible as well as infrared spectrums). Further, exemplary embodiments can use an emitter/receiver having a one inch wide window with a linear output, or any other available sensors.

It will be appreciated by the skilled in the art that the present invention can be embodied in other specific forms without departing from the spirit of the essential character thereof. The presently disclosed embodiments are therefore considered in all respects to be illustrative and not restrictive. The scope of the invention is indicated by the appended claims rather than the foregoing description and all changes which come within the meaning and range of equivalents thereof are intended to be embraced therein.

What is claimed is:

1. Printing press comprising:

means for transporting a web along a path from a web input to a web output;

means for correcting a lateral shift of said web at a first location along said path which is between said web input and said web output, said lateral shift being corrected with respect to a selected absolute position and in response to a relative lateral shift of the web;

means for detecting said relative lateral shift using a detector at a second location which is between said web input and said first location, said relative lateral shift being detected with respect to a setpoint that differs from the selected absolute position;

means for detecting an absolute position of the web relative to said selected absolute position at a third location which is between said second location and said web output; and wherein said relative lateral shift detecting means and said absolute position detecting means each measure lateral web positions of differing magnitudes and frequencies.

2. Printing press according to claim 1, wherein said transporting means includes at least one idler roll.

3. Printing press according to claim 2, wherein said correcting means further includes:

a pivotable web carriage.

4. Printing press according to claim 3, wherein said correcting means further includes:

a controller operably connected to said pivotable web carriage to rotate said web carriage in response to an output from said detecting means.

5. Printing press according to claim 4, wherein said correcting means corrects lateral shifts of said web which occur at rates of higher than 0.002 inches/seconds.

6. Printing press according to claim 1, wherein said correcting means further includes:

a pivotable web carriage.

7. Printing press according to claim 6, wherein said correcting means further includes:

a controller operably connected to said pivotable web carriage to rotate said web carriage in response to an output from said detecting means.

8. Printing press according to claim 1, wherein the absolute position detected by said absolute position detecting means is fed back to said correcting means for combination with the relative lateral shift.

9. Printing press according to claim 1, wherein said detecting means further comprise:

an infrared sensor.

10. Apparatus for guiding a web comprising:

a rotatably mounted web carriage having at least one web support roll;

a first web edge sensor located on an input side of said rotatably mounted web carriage;

a second web edge sensor located on the output side of said rotatably mounted web carriage;

a computer controlled carriage drive which rotates said web carriage with respect to a selected absolute position of the web in response to a relative position of the web received from said web first edge sensor; and wherein said first web edge sensor detects a relative position of said web relative to a setpoint, and said second web edge sensor detects an absolute position of said web relative to said selected absolute position, wherein said first web edge sensor and second web edge sensor measure lateral web positions of differing magnitudes and frequencies.

11. Method for correcting lateral shifts of a moving web in a printing press, comprising the steps of:

transporting a web along a path from a web input to a web output;

correcting a lateral shift of said web at a first location along said path which is between said web input and said web output, said lateral shift being corrected with respect to a selected absolute position and in response to a relative lateral shift of the web;

detecting said relative lateral shift using a detector at a second location which is between said web input and said first location, said relative lateral shift being detected with respect to a setpoint that differs from the selected absolute position;

detecting an absolute position of said web relative to said selected absolute position at a third location which is between said second location and said web output; and wherein said relative lateral shift detecting means and said absolute position detecting means each measure lateral web positions of differing magnitudes and frequencies.

12. Method according to claim 11, further comprising a step of:

continuously monitoring said relative lateral shift and said absolute position, and repeatedly correcting the said lateral shift of said web at said first location.

13. Printing press comprising:

means for transporting a web along a path from a web input to a web output;

means for correcting a lateral shift of said web at a first location along said path which is between said web input and said web output, said lateral shift being corrected with respect to a selected absolute position and in response to a relative lateral shift of the web;

means for detecting said relative lateral shift using a detector at a second location which is between said web input and said first location, said relative lateral shift being detected with respect to a setpoint that differs from the selected absolute position; and means for detecting an absolute position of the web relative to said selected absolute position at a third location which is between said second location and said web output;

wherein said relative lateral shift detecting means identifies lateral shift errors with respect to said setpoint with a phase advance.

14. Printing press comprising:

means for transporting a web along a path from a web input to a web output;

means for correcting a lateral shift of said web at a first location along said path which is between said web input and said web output, said lateral shift being corrected with respect to a selected absolute position and in response to a relative lateral shift of the web;

means for detecting said relative lateral shift using a detector at a second location which is between said web input and said first location, said relative lateral shift being detected with respect to a setpoint that differs from the selected absolute position; and means for detecting an absolute position of the web relative to said selected absolute position at a third location which is between said second location and said web output;

wherein said relative lateral shift detecting means provides for higher frequency shift corrections of the web than are provided by said absolute position detecting means.

* * * * *